US011284492B1

(12) United States Patent
Nolan et al.

(10) Patent No.: US 11,284,492 B1
(45) Date of Patent: Mar. 22, 2022

(54) LIGHTING SYSTEM WITH ACTIVE THERMAL BALANCING

(71) Applicant: M3 Innovation, LLC, Syracuse, NY (US)

(72) Inventors: Christopher D. Nolan, Camillus, NY (US); Joseph R. Casper, Baldwinsville, NY (US)

(73) Assignee: M3 Innovation, LLC, Syracuse, NY (US)

( * ) Notice: Subject to any disclaimer, the term of this patent is extended or adjusted under 35 U.S.C. 154(b) by 0 days.

(21) Appl. No.: 17/088,867

(22) Filed: Nov. 4, 2020

(51) Int. Cl.

| | |
|---|---|
| ***H05B 47/10*** | (2020.01) |
| ***H05B 45/56*** | (2020.01) |
| ***F21S 8/08*** | (2006.01) |
| ***H05B 47/105*** | (2020.01) |

(52) U.S. Cl.
CPC ..... *H05B 45/56* (2020.01); *H05B 47/105* (2020.01)

(58) Field of Classification Search
CPC ..... H05B 45/10; H05B 45/28; H05B 45/30; H05B 45/56; H05B 47/10; H05B 47/105; H05B 47/22; F21S 8/00; F21S 8/085; F21S 8/086; F21S 8/08
See application file for complete search history.

(56) References Cited

U.S. PATENT DOCUMENTS

| | | | | |
|---|---|---|---|---|
| 7,791,492 | B2 * | 9/2010 | Nam | H05B 47/19 340/635 |
| 8,575,861 | B1 * | 11/2013 | Gordin | H05B 45/12 315/307 |
| 2005/0276053 | A1 * | 12/2005 | Nortrup | F21V 29/677 362/294 |
| 2014/0239819 | A1 * | 8/2014 | Wang | H05B 47/175 315/154 |
| 2016/0131356 | A1 * | 5/2016 | Engberg | F21V 21/14 362/373 |
| 2020/0271292 | A1 * | 8/2020 | White, III | F21S 8/085 |

* cited by examiner

*Primary Examiner* — Thai Pham
(74) *Attorney, Agent, or Firm* — Bond Schoeneck and King PLLC; David Nocilly

(57) ABSTRACT

A lighting system that can thermally balance the usage of elements of the system to manage the wear rates of lifetime limiting components. The lighting system includes multiple light emitting diode illumination sources, each of which driven by a light emitting diode driver positioned in a separate housing remotely from a luminaire. A controller supervises all of the light emitting diode drivers and can adjust the power out of any of the light emitting diode drivers that are experiencing a faster loss of lifespan due to local conditions. The controller may also activate a thermal cooling device positioned in the housing of the light emitting diode driver to stabilize the temperature of a light emitting diode driver with an out of balance temperature, thereby reducing the loss of lifetime relative other drivers operating at lower temperatures.

14 Claims, 9 Drawing Sheets

LIGHTING SYSTEM WITH ACTIVE THERMAL BALANCING

BACKGROUND OF THE INVENTION

1. Field of the Invention

The present invention relates to sports lighting systems and, more specifically, to a power system having active thermal balancing.

2. Description of the Related Art

Conventional sports lighting systems rely on individual luminaires that are mounted along the cross-arms of a support pole. Each luminaire must be connected to the requisite power conversion and supply electronics, which can be positioned remotely from the luminaire. For example, some new approaches to sports lighting system provide power supply and illumination control system in a stack positioned against the support pole. When the power supplies are stacked vertically, however, the power supplies (and internal components) can vary significantly in temperature depending on the position on the pole. For example, generally, the higher a unit is positioned on a pole the more it is subject to the buoyant nature of natural convection. As a result, the illumination driver module within a single system could experience different wear rates and thus overall lifetime. In addition, differential driving of each module can also impact the relative wear rate among the driver modules of the lighting system. Accordingly, there is a need in the art for an approach that can actively balance the thermal conditions of the lighting system so that the driver modules in a given system maintain an equivalent lifetime regardless of how the driver modules are mounted or how they are driven over time.

BRIEF SUMMARY OF THE INVENTION

The present invention is a lighting system that can thermally balance the usage of elements of the system to manage the wear rates of lifetime limiting components. More specifically, the lighting system includes a plurality of light emitting diode illumination sources, each of which is positioned in luminaire. The system further includes a plurality of light emitting diode drivers, each of which is positioned in a separate housing and includes a controllable power supply for supplying an amount of power to a corresponding one of light emitting diode illumination sources and includes a sensor capable of outputting a temperature. A controller is coupled to the controllable power supply and temperature sensor of each of the plurality of light emitting diode drivers. The controller is programmed to independently control the controllable power supply of each of the plurality of light emitting diode drivers based on the temperature that is output from the sensor of each of plurality of light emitting diode drivers. For example, the controller may programmed to compare the temperature of each the plurality of light emitting diode drivers to determine whether any of the plurality of light emitting diode drivers is reaching a finite lifetime associated a component of each of the plurality of light emitting diode drivers faster than any other of the plurality of light emitting diode drivers. The controller may then be programmed to reduce the amount of power provided by the controllable power supply of any of the plurality of light emitting diode drivers that is reaching the finite lifetime faster than any other of the plurality of light emitting diode drivers. The lighting system may also include a thermoelectric cooling device associated with each of the plurality of light emitting diode drivers. The controller may then be programmed to operate the thermoelectric cooling device of each of the plurality of light emitting diode drivers based on the temperature output from each of the plurality of sensors. The controller may also be programmed to operate the thermoelectric cooling device of any one of the plurality of light emitting diode drivers that is reaching the finite lifetime faster than any other of the plurality of light emitting diode drivers.

The present invention also includes a method of balancing the usage of a light system. In a first step, the method includes providing a plurality of light emitting diode illumination sources, each of which is positioned in luminaire, a plurality of light emitting diode drivers, each of which is positioned in a housing and includes a controllable power supply for supplying an amount of power to a corresponding one of light emitting diode illumination sources and includes a sensor capable of outputting a temperature, a controller coupled to the controllable power supply and the temperature sensor of each of the plurality of light emitting diode drivers. In a next step, the controller is used to adjust the amount of power supplied by the controllable power supply of each of the plurality of light emitting diode drivers based on the temperature of each of the plurality of light emitting diode drivers. The step of using the controller to adjust the amount of power supplied by the controllable power supply of each of the plurality of light emitting diode drivers based on the temperature of each of the plurality of light emitting diode drivers may comprise comparing the temperature of each the plurality of light emitting diode drivers to determine whether any of the plurality of light emitting diode drivers is reaching a finite lifetime associated with a component of each of the plurality of light emitting diode drivers faster than any other of the plurality of light emitting diode drivers. The step of using the controller to adjust the amount of power supplied by the controllable power supply of each of the plurality of light emitting diode drivers based on the temperature of each of the plurality of light emitting diode drivers may further comprise reducing the amount of power provided by the controllable power supply of any of the plurality of light emitting diode drivers that is reaching the finite lifetime faster than any other of the plurality of light emitting diode drivers. If the plurality of light emitting diode drivers each include a thermoelectric cooling device, the step of using the controller to adjust the amount of power supplied by the controllable power supply of each of the plurality of light emitting diode drivers based on the temperature of each of the plurality of light emitting diode drivers further can comprise operating the thermoelectric cooling device of each of the plurality of light emitting diode drivers based on the temperature output from each of the plurality of sensors. The step of using the controller to adjust the amount of power supplied by the controllable power supply of each of the plurality of light emitting diode drivers based on the temperature of each of the plurality of light emitting diode drivers may additionally comprise operating the thermoelectric cooling device of any one of the plurality of light emitting diode drivers that is reaching the finite lifetime faster than any other of the plurality of light emitting diode drivers.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
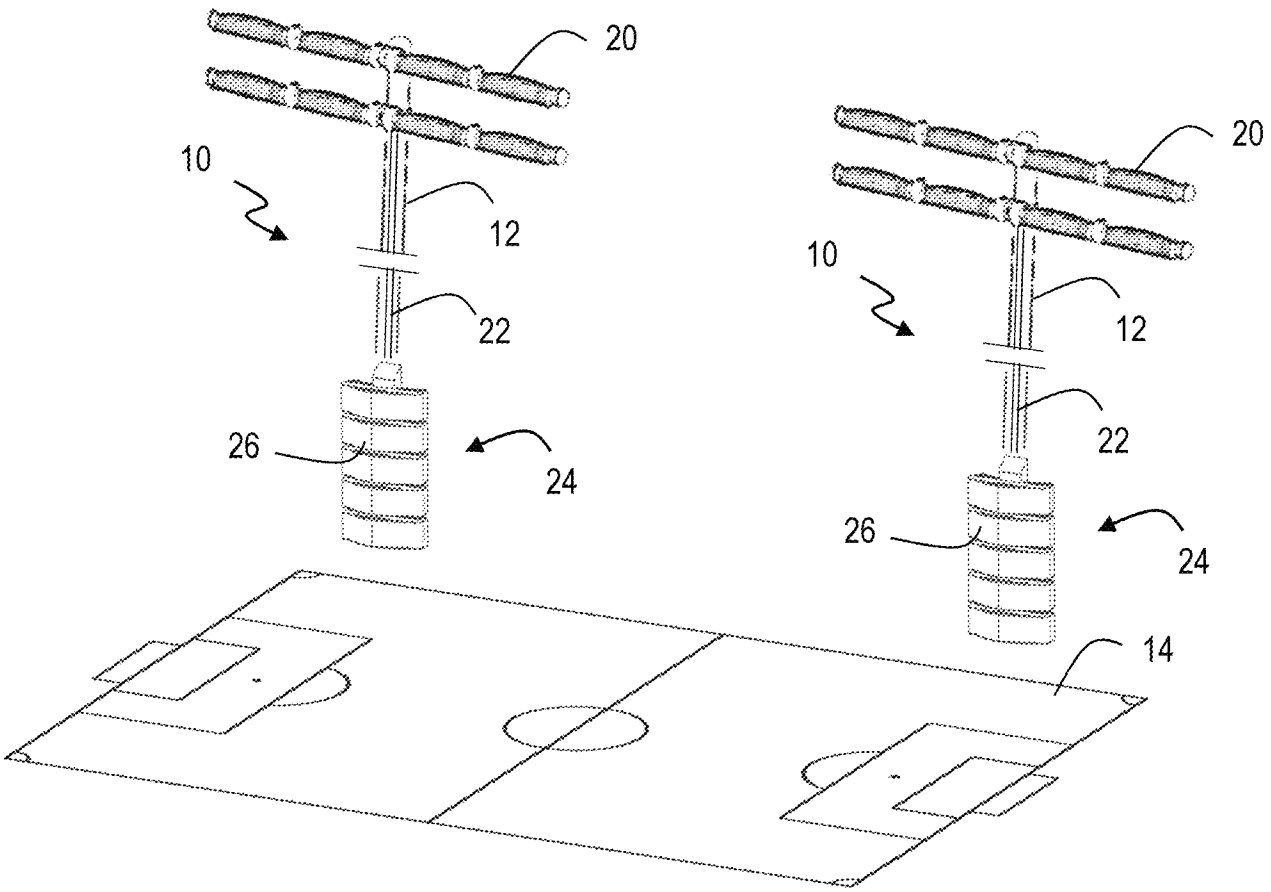
FIG. 1 is a perspective view of a sports lighting system according to the present invention.

Referring to the figures, wherein like numeral refer to like parts throughout, there is seen in FIG. 1 a source sports lighting system 10 according to the present invention. System 10 is designed for installation on a support pole 12 to provide illumination over a target area 14, such as a sporting field or pitch. System 10 includes one or more lighting modules 20, also called luminaires, that extend laterally from support pole 12. Lighting modules 20 are powered via a wiring harness 22 that extends along the interior of support pole 12 and is coupled to a controller stack 24. Controller stack 24 transforms local building power from AC to DC and includes LED drivers 26 for driving and controlling the illumination of lighting modules 20.

Figure 2:
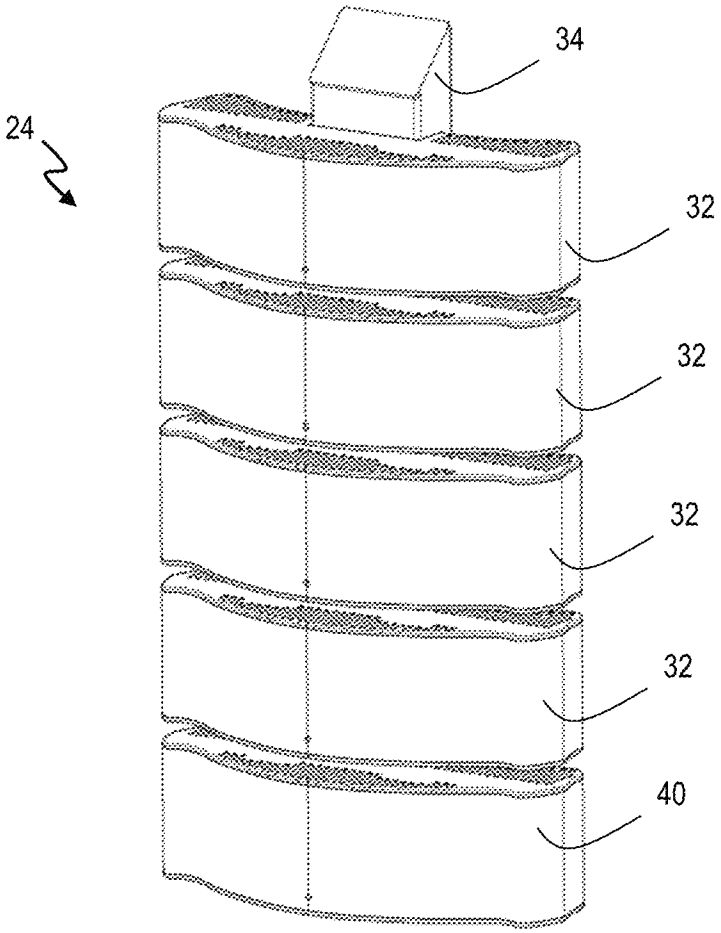
FIG. 2 is a perspective view of a controller stack according to the present invention.
Figure 3:
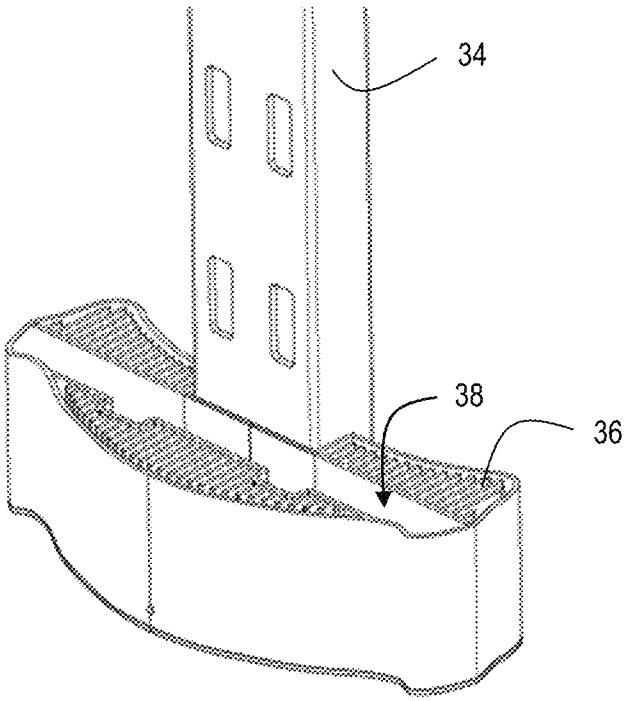
FIG. 3 is a perspective view of a core enclosure according to the present invention.

Referring to FIG. 2, controller stack 24 comprises a series of core enclosures 32, each of which houses the power conversion and LED electronics, typically referred to as LED drivers, for an associated lighting module 20, as well as a master enclosure 40 that provides housekeeping functions. Controller stack 24 includes a back plane 34 that provides the electrical interconnections between each core enclosure 32 and master enclosure 40 as well as the requisite interconnections to wiring harness 22 to interconnect controller stack 24 to lighting modules 20. Back plane 34 is preferably adapted to act as a heat sink and transfer excess heat to support pole 12 for additional dispersion of heat generated by controller stack 24. As seen in FIG. 3, core enclosure 132 and/or master enclosure 140 include ribs 136 for dissipation of heat generated by internal electrical components positioned in a central cavity 38.

Figure 4:
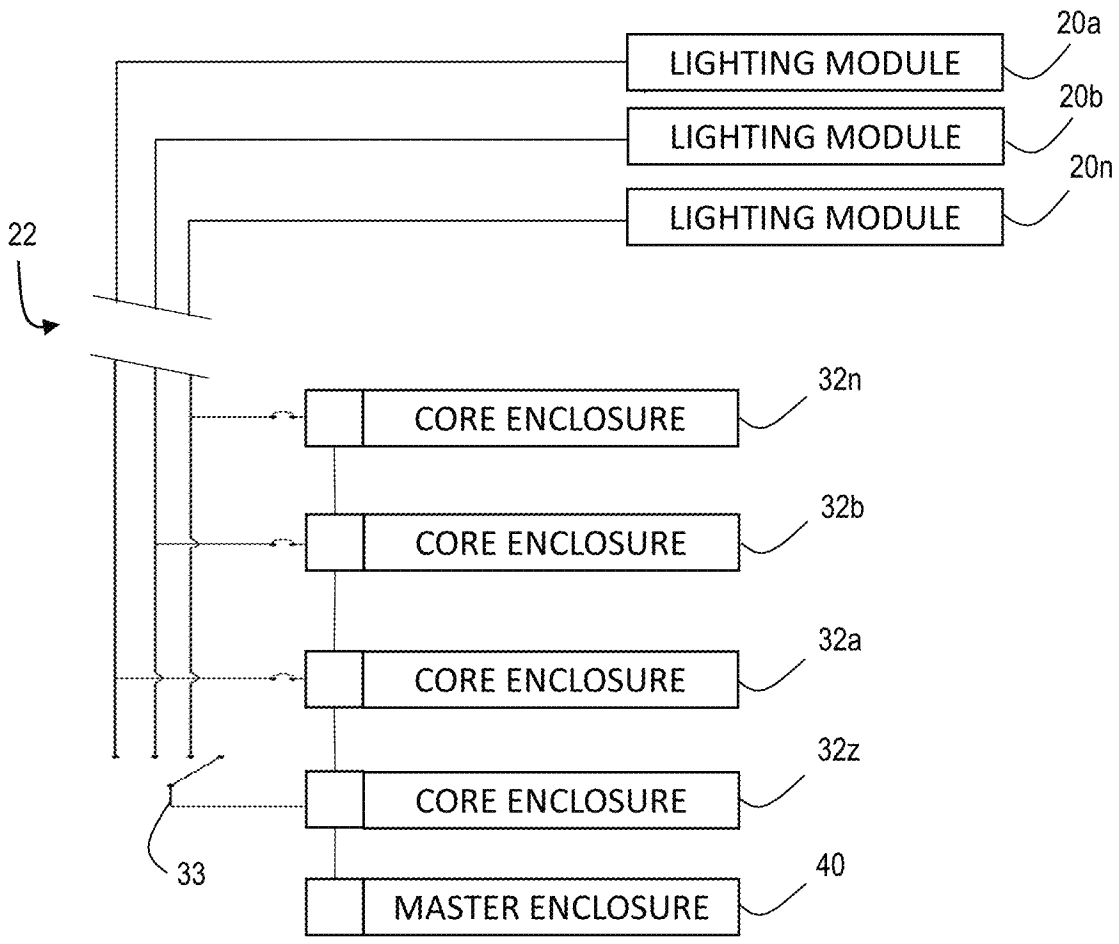
FIG. 4 is high level schematic for a lighting system according to the present invention.

Referring to FIG. 4, each core enclosure 32*a*, 32*b* . . . 32*n* is associated with and coupled via wiring harness 22 to a corresponding lighting module 20*a*, 20*b* . . . 20*n*. Preferable, a backup core enclosure 32*z* is selectively coupled to each lighting module 20*a*, 20*b* . . . 20*n* via a switching circuit 33 to provide a backup power supply in the event of a fault in any of core enclosure 32*a*, 32*b* . . . 32*n*. For example, if a fault in any core enclosure 32 results in the loss of illumination from any or all of the independently controlled rows 50 of LED sets 52 in the corresponding lighting module 20, power to that lighting module 20 can be switched to the backup core enclosure 32*z* to maintain the desired amount of illumination until such time as the faulty core enclosure 32 can be repaired or replaced. Each core enclosure 32*a*, 32*b* . . . 32*n* is also interconnected to master enclosure 40, which supervises and controls via digital commands the local operation of each core enclosure 32*a*, 32*b* . . . 32*n*.

Figure 5:
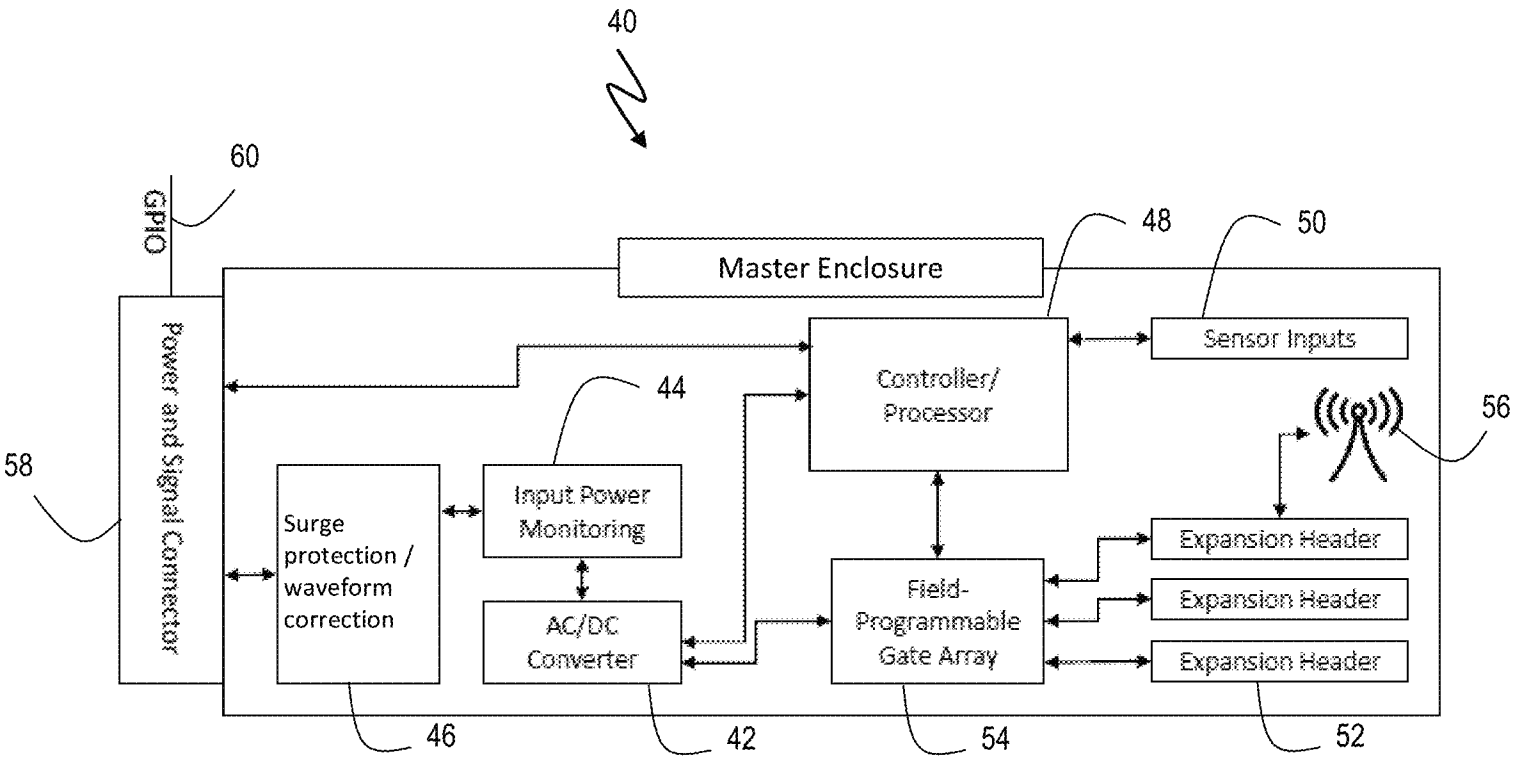
FIG. 5 is a detailed schematic of a master controller according to the present invention.

Referring to FIG. 5, master enclosure 40 is coupled to AC power via a power and signal connector 58 and includes local AC/DC conversion 42 with input power monitoring 44 as well as surge protection and waveform correction 46. Master enclosure 40 also includes a controller/processor 48 that has sensor inputs 50 for monitoring of system 0. Controller/processor 48 is also interconnected to a series of expansion headers 52 and wireless communication interface 56 via a field programmable gate array (FPGA) 54. Controller/processor 48 may thus be programmed to establish connection with a remotely positioned host system or remote device (such as a tablet or smartphone) that can provide commands controlling operation of lighting modules 20 using expansion headers 52 to provide the desired wireless connectivity. Communication could comprise any conventional wireless communication technology or protocol, such as WiFi, Blutetooth®, BLE, ZigBee, Z-Wave, 6loWPAN, NFC, cellular such as 4G, 5G or LTE, RFID, LoRA, LoRaWAN, Sigfox, NB-IoT, or LIDAR. Controller/processor 48 is also coupled via power and signal connector 58 for communication with core enclosures 32, such as via a general-purpose input/output (GPIO) line 60, extending in back plane 34.

Figure 6:
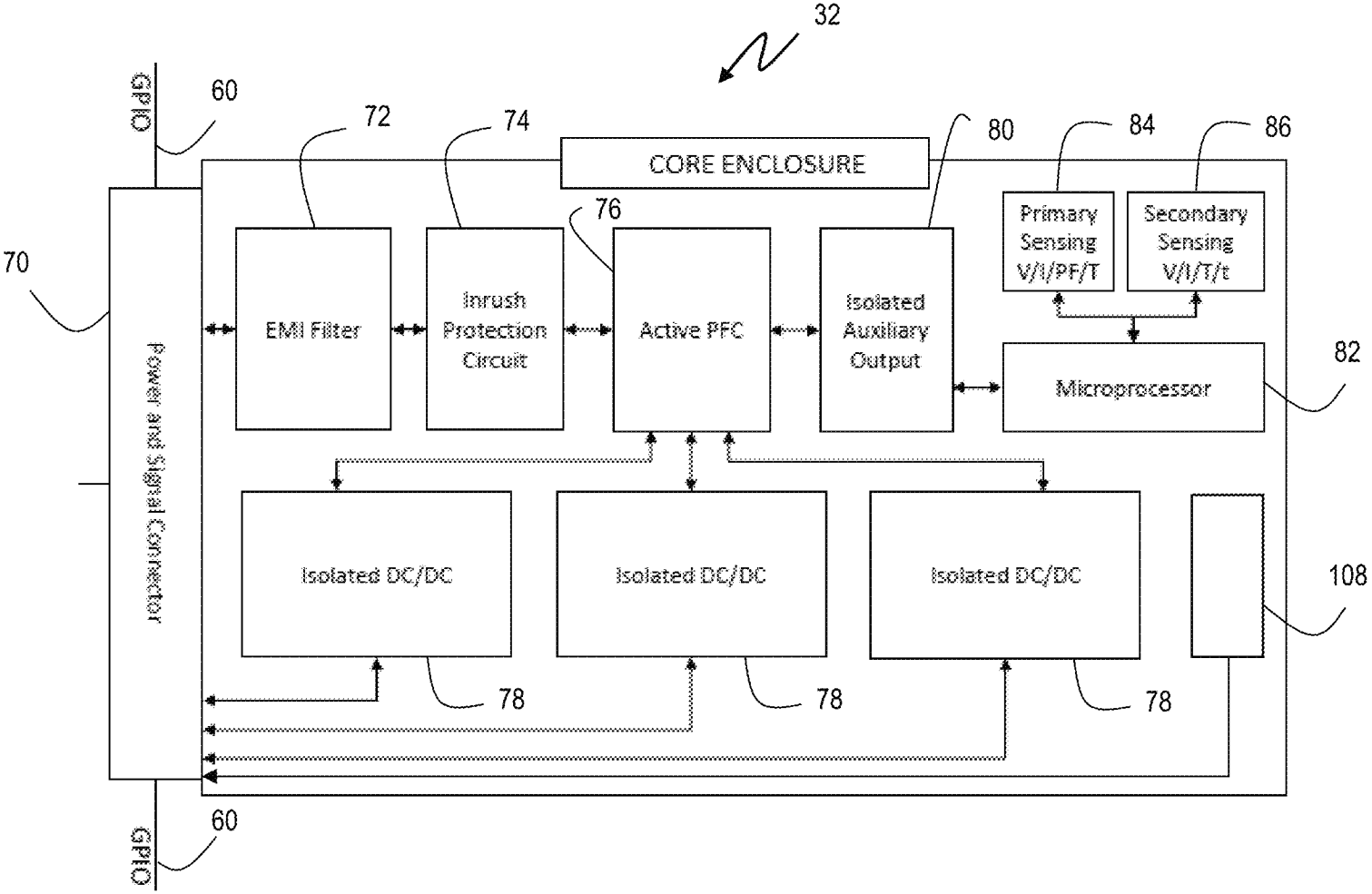
FIG. 6 is a detailed schematic of a core enclosure according to the present invention.

Referring to FIG. 6, each core enclosure 32 includes a power and signal connector 70, which provides connectivity to master enclosure 40 via GPIO line 60 as well as to a connection to AC power. Core enclosure 32 provides power conversion to DC and power conditioning via an EMI filter 72, an inrush protection circuit 74 and an active power factor corrector (PFC) 76. A plurality of isolated DC/DC circuits 78, each of which supports a corresponding one of independently controllable LED rows of illumination source 44, are coupled to active PFC 76. The present invention is illustrated with three isolated DC/DC circuits because the exemplary illumination source 44 has three independently powered rows of LEDs, but if illumination source 44 included four independently controlled rows 50 of LED sets 52, four isolated DC/DC circuits 78 would be included. Similarly, core enclosure 32 could support an illumination source 44 with just a single series of LEDs and thus only need one LED driving circuit. Core enclosure 32 further comprises an isolated auxiliary output 80 coupled to a microprocessor 82. Microprocessor 82 is further coupled to primary sensing circuits 84 and secondary sensing circuits 86 for monitoring voltage, current, power factor, and temperature across the components of system 10. Microprocessor 82 is further configured to adjust the power output from each of the plurality of isolated DC/DC circuits 78 based on monitoring of primary sensing circuits 84 and secondary sensing circuits 86. For example, if illumination source 44 has independently controlled rows 50 of LED sets 52 and one row is not operational, microprocessor 82 can adjust the power output from the isolated DC/DC circuits 78 for the other of the independently controlled rows 50 of LED sets 52 to compensate for the loss and ensure that asymmetric illumination source 44 is providing the desired amount of illumination.

Figure 7:
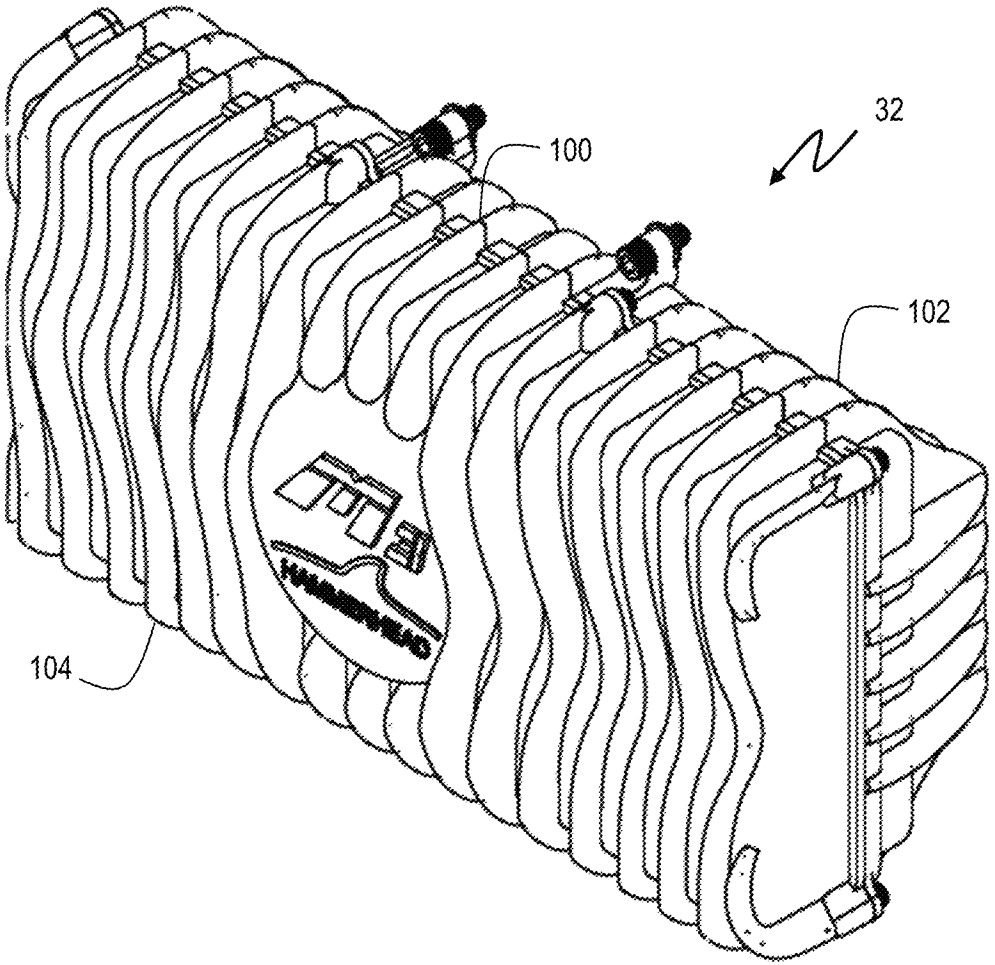
FIG. 7 is a perspective view of an embodiment of a core enclosure according to the present invention.
Figure 8:
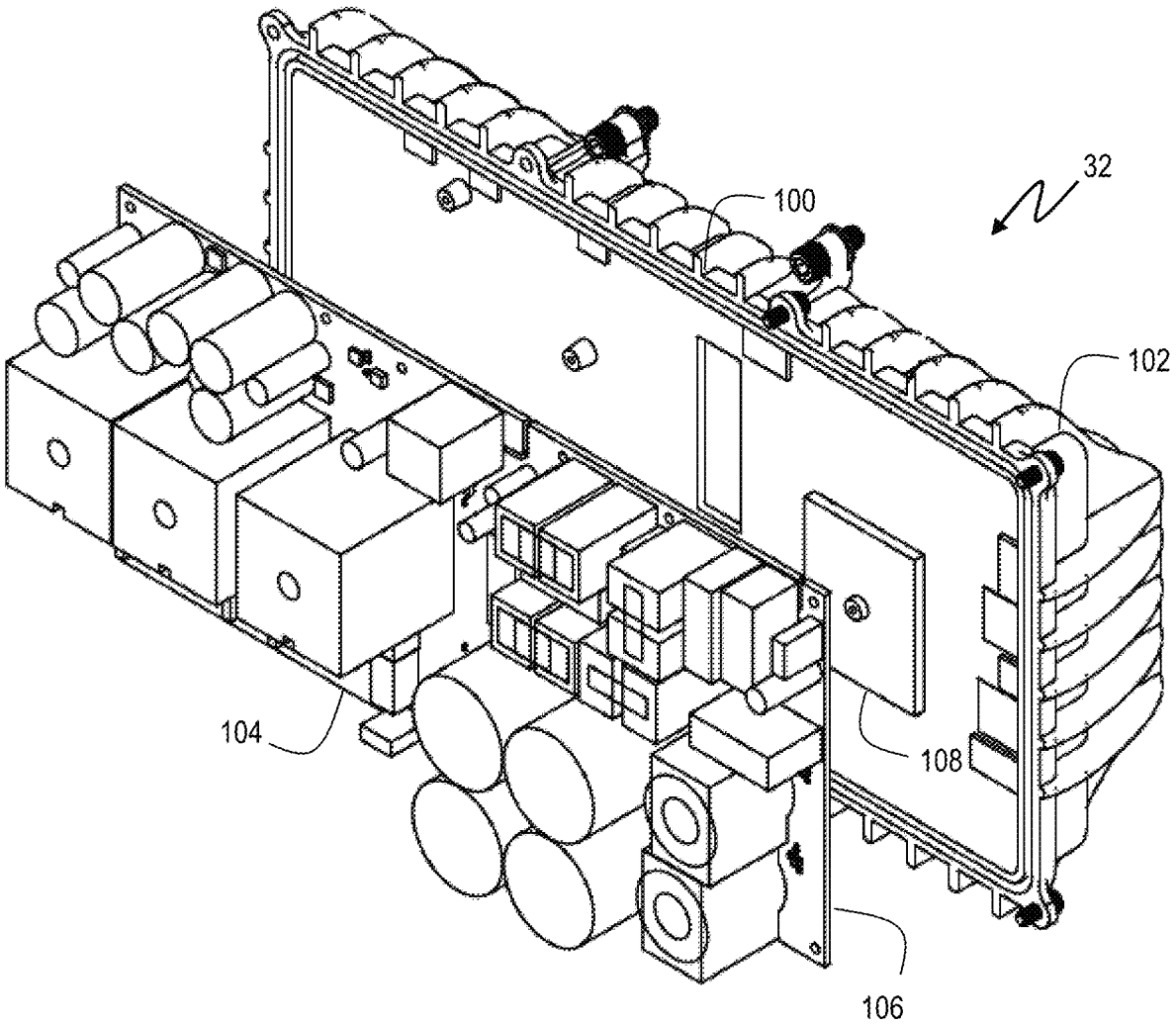
FIG. 8 is partial exploded view of an embodiment of a core enclosure according to the present invention.

Referring to FIG. 7, an embodiment of a core enclosure 32 having active thermal balancing according to the present invention comprises a housing 100 that is shaped to help dissipate heat during operation of the LED drivers contained therein, such as by including fins or other structure that increases the surface area of housing. Housing 100 includes a rear body 102 and a front cover 104 that is attached to rear body 102 to seal the interior of housing 100 against the environment. As seen in FIG. 8, housing 100 includes an electronics package 104 of the physical components that comprise the electronics detailed in FIG. 6 mounted to a substrate 106. A thermoelectric cooling device 108, such as a Peltier device, is positioned within housing 100 in proximity to electronics package 104 to selectively reduce the temperature within housing 100 and thus the temperature of electronics package 104.

Figure 9:
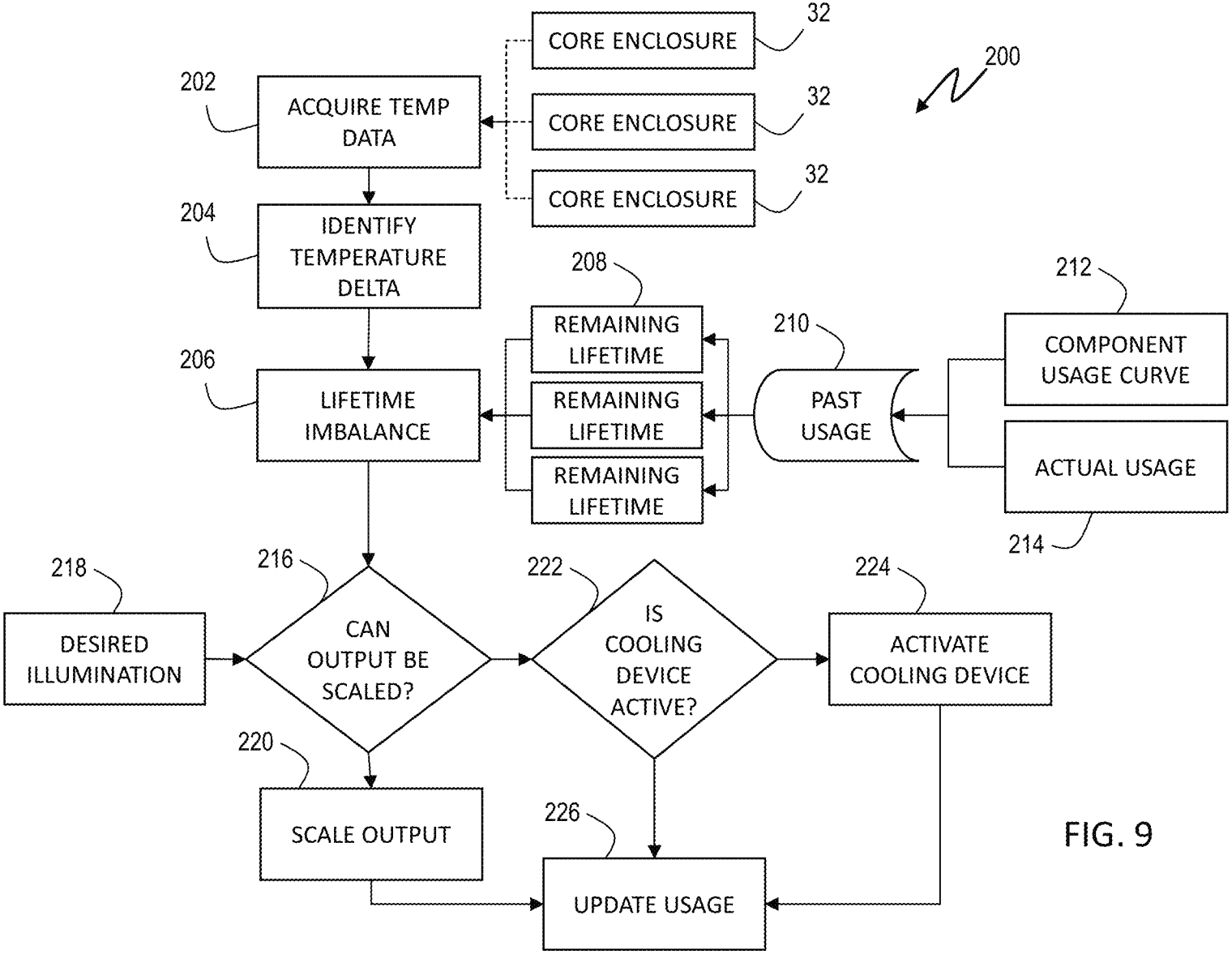
FIG. 9 is a flowchart of a thermal balancing method for a lighting system according to the present invention.

The operation of cooling device 108 of core enclosure 32, and cooling device 108 of all other core enclosures 32 mounted along back plane 34, is controlled by controller 48 of master enclosure 40. More specifically, controller 48 of master enclosure 40 is programmed to monitor the temperature of core enclosures 32, as available from primary sensing 84, and implement a thermal balancing method 200. Thermal balancing method 200 is programmed to selectively regulate the amount of power output from core enclosures 32 and any active cooling provided by cooling device 108 of each core enclosure 32 to manage the lifespan of any lifetime limiting components of electronics package 104, such as the electrolytic capacitors typically used for LED drivers. Referring to FIG. 9, thermal balancing method 200 may commence with the acquisition of temperature data 202 from all core enclosures. Next, method 200 determines whether there are any differences in temperature 204 between core enclosures 32. The difference in temperature 204 are then be used to determine whether the differences in temperature are causing an imbalance in remaining lifetime 206 between core enclosures 32. Remaining lifetime 208 for each core enclosure 32 may be tracked for any component having a limited lifetime based on a calculated past usage 210 that is stored in memory. Past usage 210 is based on component usage curves 212 for conventional lifetime limiting components, which are are typically available from the manufacturer of the components and define how usage of the component impacts its lifetime. Actual usage 214 of the components over time, such as the power output, temperature, and time of usage for core enclosure 32, may be tracked and applied to the usage curve 212 to calculate past usage 210. Remaining lifetime 206 of each core enclosure may thus be determined, such as by subtracting actual usage 210 from the expected lifetime of the lifetime limiting component. If method 200 determines that the current temperature delta 204 will cause a lifetime imbalance 206 based on remaining lifetime 208 of each core enclosure 32, a check 216 is performed to determine whether the power output of any core enclosure 32 that is out of balance can be scaled back. For example, if the desired illumination level 218 for core enclosure 32 can be met with core enclosure 32 operating at a lower power level, the power may be scaled back 220 in an attempt to lower the temperature of core enclosure and/or reduce the current usage of the out of balance core enclosure 32 that is losing more of its lifetime than other core enclosures 32. If check 216 determines that desired illumination 218 cannot be met at a lower power level, a check 222 may be performed to determine whether cooling device 108 is active. If not, cooling device 108 can be activated 224 by controller 48 for a predetermined period of time or until the temperature delta 204 is reduced or eliminated. Method 200 concludes with continued updating of usage 226 for continued monitoring of lifetime usage and future thermal balancing by reimplementing method 200. Method 200 may be executed continuously during usage of system 10 so that the lifetimes of all core enclosures 32 remain balanced so that all core enclosures 32 reach their end of the lifetime at about the same time.

As described above, the present invention may be a system, a method, and/or a computer program associated therewith and is described herein with reference to flowcharts and block diagrams of methods and systems. The flowchart and block diagrams illustrate the architecture, functionality, and operation of possible implementations of systems, methods, and computer programs of the present invention. It should be understood that each block of the flowcharts and block diagrams can be implemented by computer readable program instructions in software, firmware, or dedicated analog or digital circuits. These computer readable program instructions may be implemented on the processor of a general purpose computer, a special purpose computer, or other programmable data processing apparatus to produce a machine that implements a part or all of any of the blocks in the flowcharts and block diagrams. Each block in the flowchart or block diagrams may represent a module, segment, or portion of instructions, which comprises one or more executable instructions for implementing the specified logical functions. It should also be noted that each block of the block diagrams and flowchart illustrations, or combinations of blocks in the block diagrams and flowcharts, can be implemented by special purpose hardware-based systems that perform the specified functions or acts or carry out combinations of special purpose hardware and computer instructions.

What is claimed is:

1. A lighting system, comprising:

a plurality of light emitting diode illumination sources, each of which is positioned in a corresponding one of a plurality of luminaires; and a plurality of light emitting diode drivers, each of which is positioned in a corresponding one of a plurality of separate housings that is positioned remotely from the plurality of luminaires and each of which includes a controllable power supply that supplies an amount of power to a corresponding one of light emitting diode illumination sources and a sensor capable of outputting a temperature; and a controller coupled to the controllable power supply and the sensor of each of the plurality of light emitting diode drivers, wherein the controller is programmed to independently control the controllable power supply of each of the plurality of light emitting diode drivers based on the temperature that is output from the sensor of each of plurality of light emitting diode drivers.

2. The lighting system of claim 1, wherein the plurality of luminaires are commonly positioned at the top of a support pole and the plurality of separate housings are commonly positioned at the bottom of the support pole and interconnected to the plurality of luminaires by a wiring harness.

3. The lighting system of claim 1, wherein the controller is programmed to compare the temperature of each the plurality of light emitting diode drivers to determine whether any of the plurality of light emitting diode drivers is reaching a finite lifetime associated a component of each of the plurality of light emitting diode drivers faster than any other of the plurality of light emitting diode drivers.

4. The lighting system of claim 3, wherein the controller is positioned at the bottom of the support pole adjacent to the plurality of separate housings.

5. The lighting system of claim 3, wherein the controller is programmed to reduce the amount of power provided by the controllable power supply of any of the plurality of light emitting diode drivers that is reaching the finite lifetime faster than any other of the plurality of light emitting diode drivers.

6. The lighting system of claim 5, wherein each of the plurality of light emitting diode drivers includes a thermoelectric cooling device.

7. The lighting system of claim 6, wherein the controller is further programmed to operate the thermoelectric cooling device of each of the plurality of light emitting diode drivers based on the temperature output from each of the plurality of sensors.

8. The lighting system of claim 7, wherein the controller is programmed to operate the thermoelectric cooling device of any one of the plurality of light emitting diode drivers that is reaching the finite lifetime faster than any other of the plurality of light emitting diode drivers.

9. A method of balancing operation of a lighting system, comprising the steps of:

providing a plurality of luminaires having light emitting diode illumination sources, a plurality of light emitting diode drivers, each of which is positioned in a corresponding one of a plurality of separate housings that is positioned remotely from the plurality of luminaires and each of which includes a controllable power supply that supplies an amount of power to a corresponding one of light emitting diode illumination sources and a sensor capable of outputting a temperature, and a controller coupled to the controllable power supply and the temperature sensor of each of the plurality of light emitting diode drivers;

using the controller to adjust the amount of power supplied by the controllable power supply of each of the plurality of light emitting diode drivers based on the temperature of each of the plurality of light emitting diode drivers.

10. The method of claim 9, wherein the step of using the controller to adjust the amount of power supplied by the controllable power supply of each of the plurality of light emitting diode drivers based on the temperature of each of the plurality of light emitting diode drivers comprises comparing the temperature of each the plurality of light emitting diode drivers to determine whether any of the plurality of light emitting diode drivers is reaching a finite lifetime associated with a component of each of the plurality of light emitting diode drivers faster than any other of the plurality of light emitting diode drivers.

11. The method of claim 10, wherein the step of using the controller to adjust the amount of power supplied by the controllable power supply of each of the plurality of light emitting diode drivers based on the temperature of each of the plurality of light emitting diode drivers further comprises reducing the amount of power provided by the controllable power supply of any of the plurality of light emitting diode drivers that is reaching the finite lifetime faster than any other of the plurality of light emitting diode drivers.

12. The method of claim 11, wherein each of the plurality of light emitting diode drivers includes a thermoelectric cooling device.

13. The method of claim 12, wherein the step of using the controller to adjust the amount of power supplied by the controllable power supply of each of the plurality of light emitting diode drivers based on the temperature of each of the plurality of light emitting diode drivers further comprises operating the thermoelectric cooling device of each of the plurality of light emitting diode drivers based on the temperature output from each of the plurality of sensors.

14. The method of claim 13, wherein the step of using the controller to adjust the amount of power supplied by the controllable power supply of each of the plurality of light emitting diode drivers based on the temperature of each of the plurality of light emitting diode drivers further comprises operating the thermoelectric cooling device of any one of the plurality of light emitting diode drivers that is reaching the finite lifetime faster than any other of the plurality of light emitting diode drivers.

* * * * *